US007003255B2

(12) United States Patent
Kawasumi et al.

(10) Patent No.: US 7,003,255 B2
(45) Date of Patent: Feb. 21, 2006

(54) IMAGE FORMING APPARATUS AND PROCESS CARTRIDGE

(75) Inventors: Masanori Kawasumi, Yokohama (JP); Kazuhiko Umemura, Shizuoka (JP); Satoshi Narumi, Yokohama (JP); Hiroshi Hosokawa, Yokohama (JP); Takeichi Ryuta, Yokohama (JP); Kiyonori Tsuda, Yokohama (JP); Yuji Arai, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 80 days.

(21) Appl. No.: 10/665,494

(22) Filed: Sep. 22, 2003

(65) Prior Publication Data

US 2004/0131381 A1 Jul. 8, 2004

(30) Foreign Application Priority Data

Sep. 19, 2002 (JP) ..... 2002-273464

(51) Int. Cl.
*G03G 21/00* (2006.01)

(52) U.S. Cl. ..... 399/349; 399/102; 399/350; 399/353

(58) Field of Classification Search ..... 399/349–351, 399/353, 354, 357–360, 102
See application file for complete search history.

(56) References Cited

U.S. PATENT DOCUMENTS 4,660,962 A * 4/1987 Maekawa et al. ..... 399/354
5,124,757 A * 6/1992 Ikegawa ..... 399/359
5,233,398 A * 8/1993 Nimura et al. ..... 399/354
5,606,399 A * 2/1997 Kikui
5,619,316 A * 4/1997 Shoji et al. ..... 399/359
5,740,493 A * 4/1998 Otaki et al.
5,765,087 A * 6/1998 Yano et al. ..... 399/358
6,198,895 B1 3/2001 Tsuda et al.
6,212,343 B1 4/2001 Hosokawa et al.
6,337,957 B1 1/2002 Tamaki et al.
6,447,973 B1 9/2002 Asami et al.
6,493,529 B1 12/2002 Umemura et al.
6,521,386 B1 2/2003 Sakon et al.
6,522,855 B1 2/2003 Katoh et al.
6,558,862 B1 5/2003 Kojima et al.
6,560,431 B1 5/2003 Hosokawa
6,562,529 B1 5/2003 Kojima et al.
6,615,013 B1 9/2003 Arai et al.
2001/0017995 A1 * 8/2001 Sato et al.

(Continued)

FOREIGN PATENT DOCUMENTS

JP 06-051672 * 2/1994

(Continued)

OTHER PUBLICATIONS

U.S. Appl. No. 10/786,120, filed Feb. 26, 2004, Hosokawa et al.

(Continued)

*Primary Examiner*—Susan Lee
(74) *Attorney, Agent, or Firm*—Oblon, Spivak, McClelland, Maier & Neustadt, P.C.

(57) ABSTRACT

An image forming process and apparatus, the apparatus including a toner container, a transfer belt below the toner container, a process cartridge below the transfer belt, and an imaging device below the process cartridge. The process cartridge includes a rotating image carrier having an image carrier surface, a brush roller in contact with the image carrier surface, a charging member in contact with the image carrier surface and configured to transfer a charge to the image carrier surface, and a casing including a miler in contact with the image carrier surface and arranged to separate the brush roller from the charging member.

36 Claims, 5 Drawing Sheets

U.S. PATENT DOCUMENTS

2002/0028093 A1 * 3/2002 Miyoshi et al.

FOREIGN PATENT DOCUMENTS

JP 8-137198 5/1996
JP 09-297519 * 11/1997

OTHER PUBLICATIONS

U.S. Appl. No. 09/947,391, filed Sep. 7, 2001, Kawagoe et al.
U.S. Appl. No. 10/059,240, filed Jan. 31, 2002, Sugiura et al.
U.S. Appl. No. 10/059,239, filed Jan. 31, 2002, Mochizuki et al.
U.S. Appl. No. 10/092,488, filed Mar. 8, 2002, Arai et al.
U.S. Appl. No. 10/107,157, filed Mar. 28, 2002, Masuda et al.
U.S. Appl. No. 10/153,627, filed May. 24, 2002, Suzuki et al.
U.S. Appl. No. 10/212,736, filed Aug. 7, 2002, Sugiura et al.
U.S. Appl. No. 10/318,109, filed Dec. 13, 2002, Sugiura et al.
U.S. Appl. No. 10/352,075, filed Jan. 28, 2003, Kojima et al.
U.S. Appl. No. 10/376,355, filed Mar. 3, 2003, Kojima et al.
U.S. Appl. No. 10/405,630, filed Apr. 3, 2003, Suda et al.
U.S. Appl. No. 10/418,111, filed Apr. 18, 2003, Kawahara et al.
U.S. Appl. No. 10/609,399, filed Jul. 1, 2003, Katoh et al.
U.S. Appl. No. 10/820,726, filed Apr. 9, 2004, Koike et al.
U.S. Appl. No. 10/792,694, filed Mar. 5, 2004, Tsuda et al.
U.S. Appl. No. 10/836,264, filed May. 3, 2004, Shintani et al.
U.S. Appl. No. 10/859,292, filed Jun. 3, 2004, Tsuda et al.
U.S. Appl. No. 10/874,269, filed Jun. 24, 2004, Murakami et al.
U.S. Appl. No. 10/884,979, filed Jul. 7, 2004, Fukuchi et al.
U.S. Appl. No. 10/921,993, filed Aug. 20, 2004, Amemiya et al.
U.S. Appl. No. 10/926,180, filed Aug. 26, 2004, Kimura et al.
U.S. Appl. No. 10/912,207, filed Aug. 6, 2004, Watanabe et al.
U.S. Appl. No. 11/100,813, filed Apr. 7, 2005, Ojimi et al.

* cited by examiner

IMAGE FORMING APPARATUS AND PROCESS CARTRIDGE

CROSS REFERENCE TO RELATED APPLICATIONS

This application claims priority to Japanese Patent Publication 2002-27463 filed on Sep. 19, 2003, the entire contents of which are incorporated by reference.

BACKGROUND OF THE INVENTION

1. Field of the Invention

The present invention relates to an elect-photographic image forming apparatus, to include a printer or a facsimile device, and a corresponding process cartridge.

2. Description of the Related Art

In conventional image forming apparatuses, use of a diffusion means, such as a sweep roller, to loosen toner from an image carrier is known. Typically, the sweep roller is kept in constant contact with the image carrier. Such diffusion means are installed with various kinds of objects.

One purpose of the sweep roller is to loosen toner adhered to the image carrier so that toner may be easily collected and recycled by a toner dispenser device. An advantage of a sweep roller is that it is not necessary to install a dedicated cleaning device to clean the image carrier thereby allowing for miniaturization, improved reliability, and reduced production costs.

An example of a conventional image forming apparatus is found in Japanese Patent Laid-Open No. HEI8-137198 which teaches an image forming apparatus comprising a combination sweep/charging roller 2 that also functions as an electrical charging roller. The combination sweep/charging roller 2 loosens and/or scatters residual toners on an image carrier 1. The loosened toner is captured by the toner dispenser/recycler 4.

However, when diffusing, loosened toner can also scatter from the combination sweep/charging roller 2 for a great distance. Scattered toner can then adhere to other surfaces causing various problems and malfunctions, to include abnormal pictures.

In addition, the loosened toner can adhere to the brushes of the combination sweep/charging roller 2, thereby impeding the ability of the combination sweep/charging roller 2 to transfer an electrical charge to the image carrier 1. For example, uneven charging is possible which will lead to uneven density of toner on the image carrier 1 which, in turn will lead to abnormal picture development.

Also, Applicants' application Ser. No. 09/903,787 filed on Jul. 13, 2001, the entire contents of which are incorporated herein by reference, teaches angled disposition of an imaging device 8 over an angled process cartridge section 3 over an angled transfer belt 20. However, this construction results in largely unusable space being left under this configuration and, thus, is not optimized for miniaturization for desktop use. Furthermore, this prior application does not teach a removable toner container separate from a removable process cartridge. Thus, the cartridges must be replaced or recycled when the toner is depleted, which is typically sooner than when the mechanical components of the cartridges are worn out, thus increasing operational costs.

SUMMARY OF THE INVENTION

The present invention has been developed in order to solve at least the above-mentioned problems. It is an object of the present invention to provide an image forming apparatus and a process cartridge that reduces toner scatter and more evenly and reliably applies an electric charge to an image carrier. It is another object of the present invention to provide a process cartridge that is easy to install and remove. It is another objective of the present invention to provide for miniaturization for desk-top and other uses.

One embodiment of the present invention is an image forming apparatus that includes a moving image carrier, a means for diffusing residual toner adhered to the surface of the image carrier, a means for applying a charge to the image carrier separate from the means for diffusing, and a means for separating the means for diffusing from the means for applying a charge.

One embodiment of the present invention is an image forming apparatus including a toner dispensing section, a transfer belt below the toner dispensing section, a plurality of process cartridges below the transfer belt, and an imaging section below the plurality of process cartridges. Each of these components are arranged within the image forming apparatus on a downward slant. Each of the process cartridges are arranged so that an upper cartridge that is adjacent to a lower cartridge also vertically overlaps the lower cartridge.

The other objects, features and advantages of the present invention are specifically set forth in or will become apparent from the following detailed descriptions of the invention when read in conjunction with the accompanying drawings.

DETAILD DESCRIPTION

A printer using elect-graph system as the image forming apparatus ("a printer" is merely said as follows) of the present invention will be explained below with reference to the accompanying drawings. This printer consists of four colors toner such as yellow (Y), cyan (C.), magenta (M), and black (K).

Figure 1:
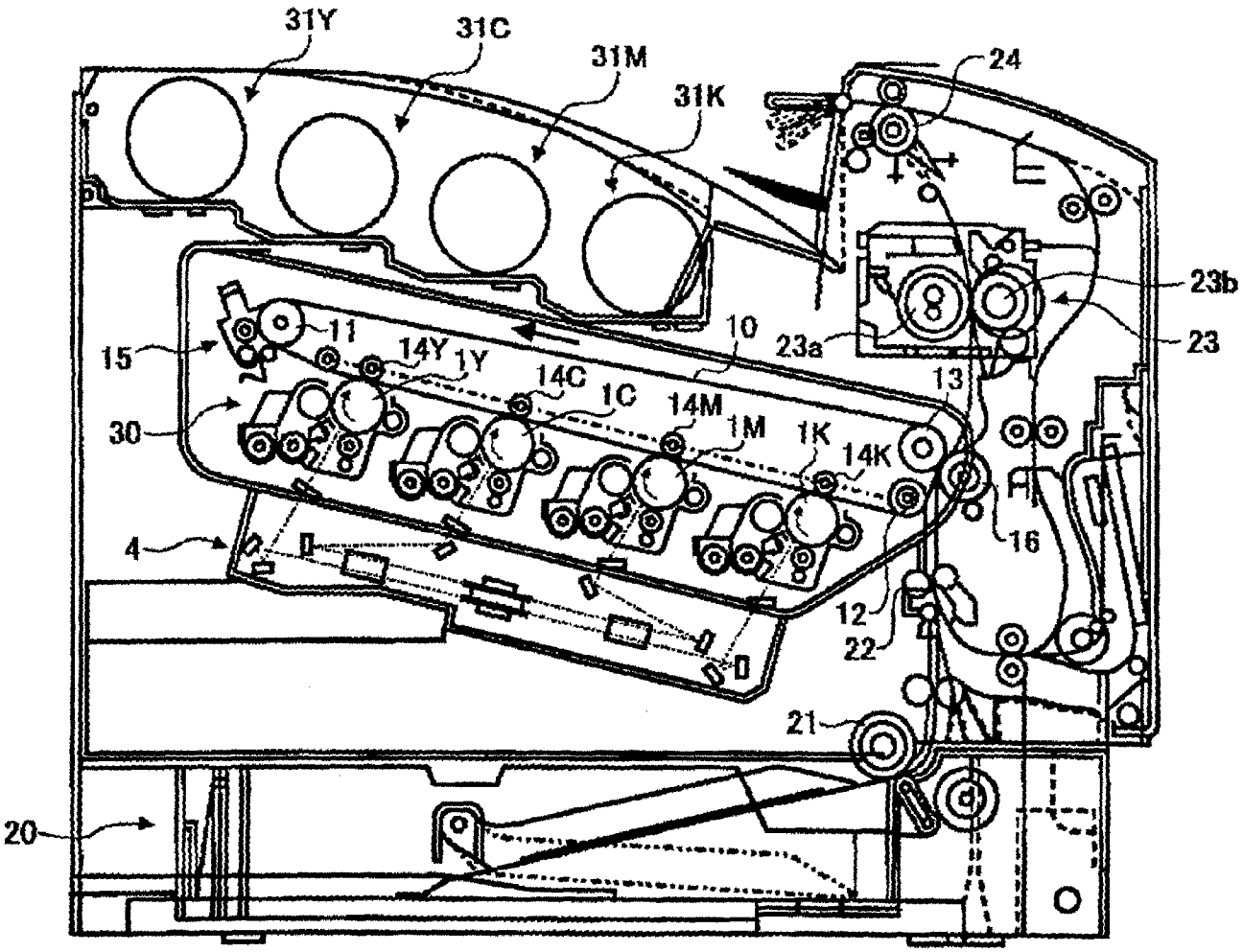
FIG. 1 shows an interior construction of a printer according to an embodiment of the present invention.

FIG. 1 shows a figure of outline constitution of a printer related to a present embodiment. This printer comprises four photoreceptor drums 1Y, 1C, 1M, and 1K which are a latent image carrier as an image carrier. (In the figure, a drum-shaped photoreceptor is shown for example, but a belt-shaped photoreceptor can also be used.) Each photoreceptor 1Y, 1C, 1M, and 1K are touching transfer belt 10 as no edge transfer members configured for surface transfer. Each is driven in a direction of mark in the figure.

Each photoreceptor drum 1Y, 1C, 1M, 1K, has the structure that the exposure layer is composed above a cylindrical electroconductivity body which is a comparatively thin. There is also a conservation layer formed on the exposure layer. In one embodiment, the outer diameter of photoreceptor drum is 30 mm and the inside diameter is 28.5 mm. Other dimensions are possible.

In the present embodiment, an organic photoreceptor is used because of being low cost, having wide designing flexibility, and not causing environmental pollution. As for the organic photoreceptors, the following photoreceptors are known: (1) photoreceptors including a photoconductive resin such as polyvinyl carbaozole (PVK); (2) charge transfer type photoreceptors including a charge transfer complex such as a combination of polyvinyl carbaozole (PVK) and 2,4,7-trinitrofluorenone (TNF); (3) pigment-dispersion type photoreceptors in which a pigment, such as phthalocyanine, is dispersed in a binder resin; and (4) functionally-separated photoreceptors including a charge generation material and a charge transport material. Among these organic photoreceptors, the functionally-separated photoreceptors are preferred.

Figure 2:
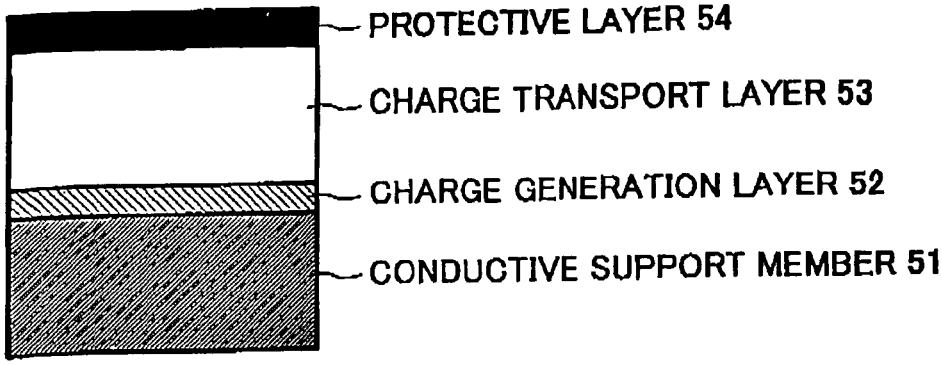
FIG. 2 shows an interior construction of a toner applying and cleaning cartridge used in the printer of FIG. 1.

FIG. 2 illustrates a cross section of a photoreceptor drum 1 for use in the present embodiment. The photoreceptor drum 1 is a functionally-separated photoreceptor and has a configuration such that a charge generation layer 52, a charge transport layer 53, a protective layer 54 are overlaid on an electroconductive substrate 51. The mechanism of formation of an electrostatic latent image on the photoreceptor drum 1 is as follows.

When the photoreceptor drum 1 is charged and then exposed to light, the light passes through the charge transport layer 53 which is transparent, and is absorbed by a charge generation material in the charge generation layer 52. The charge generation material, which has absorbed light, generates charge carriers. The charge carriers are injected to the charge transport layer 53 and move through the charge transport layer 53 due to the electric field formed by charging the photoreceptor drum 1, resulting in neutralization of the charge on the surface of the photoreceptor drum 1. The neutralized portion is an electrostatic latent image. It is preferable for such functionally-separated photoreceptors to use a combination of a charge transport material having a strong absorption in an ultraviolet region and a charge generation material having a strong absorption in a visible region.

Suitable materials for use in the protective layer 54 include ABS resins, ACS resins, olefin-vinyl monomer copolymers, chlorinated polyether resins, aryl resins, phenolic resins, polyacetal resins, polyamide resins, polyamideimide resins, polyacrylate resins, polyarylsulfone resins, polybutylene resins, polybutylene terephthalate resins, polycarbonate resins, polyethersulfone resins, polyethine resins, polyethylene terephthalate resins, polyimide resins, acrylic resins, polymethylpentene resins, polypropylene resins, polyphenylene oxide resins, polysulfone resins, AS resins, AB resins, BS resins, polyurethane resins, polyvinyl chloride resins, polyvinylidene chloride resins, epoxy resins, etc.

A filler can be included in the protective layer 54 to improve the abrasion resistance thereof. Suitable materials for use as the filler include fluorine-containing resins such as polytetrafluoroethylene, and silicon resins, in which an inorganic material such as titanium oxide, tin oxide, potassium titanate, silica and alumina can be included. The content of the filler in the protective layer 54 is from 10 to 40% by weight, and preferably from 20 to 30% by weight. When the filler content is less than 10% by weight, the abrasion resistance of the photoreceptor drum 1 tends to deteriorate, although the abrasion resistance depends on the configuration of the members arranged around the photoreceptor drum 1, such as a charger and a cleaner. In contrast, when the filler content is greater than 40% by weight, the photoreceptor has poor photosensitivity. A dispersant can be included to the protective layer to well disperse the filler in the protective layer. Suitable dispersants for use in the protective layer include known dispersants which can be used for coating liquids. The content of the dispersant in the protective layer is from 0.5 to 4% by weight, and preferably from 1 to 2% by weight, based on the weight of the filler in the protective layer. In addition, it is preferable to include a charge transport material in the protective layer. Further, an antioxidant can be included in the protective layer, if desired.

In order to form the protective layer 54, known coating methods such as dip coating, spray coating, bead coating, nozzle coating, spinner coating, and ring coating can be used. In one embodiment, the thickness of the protective layer is from 0.5 to 10 $\mu$m, and preferably from 4 to 6 $\mu$m. An intermediate layer can be formed between the photo sensitive layer including the charge generation layer 52 and the charge transport layer 53, and the protective layer 54. The intermediate layer includes a resin as a main component. Suitable resins for use in the intermediate layer include polyamides, alcohol-soluble nylons, water-soluble polyvinyl butyrals, polyvinyl butyrals, polyvinyl alcohols, etc. In order to form the intermediate layer, the known coating methods mentioned above for use in formation of the protective layer can be used. The thickness of the intermediate layer is preferably from 0.05 to 2 $\mu$m.

Use of an organic photoreceptor drum 1 has reduced chemical and mechanical durability as compared to other drum constructions. Many of electric charge transportation materials are developed as a low molecular compound. Because it cannot easily form thin layers, this low molecular compound is usually mixed with non-activity macromolecule. However, the electric charge transportation layer consists of a low molecular compound as an electric charge transportation material and a non-active macromolecule which is generally soft, and has poor mechanical durability. Therefore, if photoreceptor drum 1 having the electric charge transportation layer is used over and over, rubbing with arrangements such as charging roller 3*a* which is a charging member touching with photoreceptor drum 1, developer, transfer belt 10, and brush roller 41 makes the membrane of photoreceptor drum 1 shaven. Particularly using organic photoreceptor as photoreceptor 1, it is effective to install conservation layer 54 in order to lengthen the life.

Figure 3:
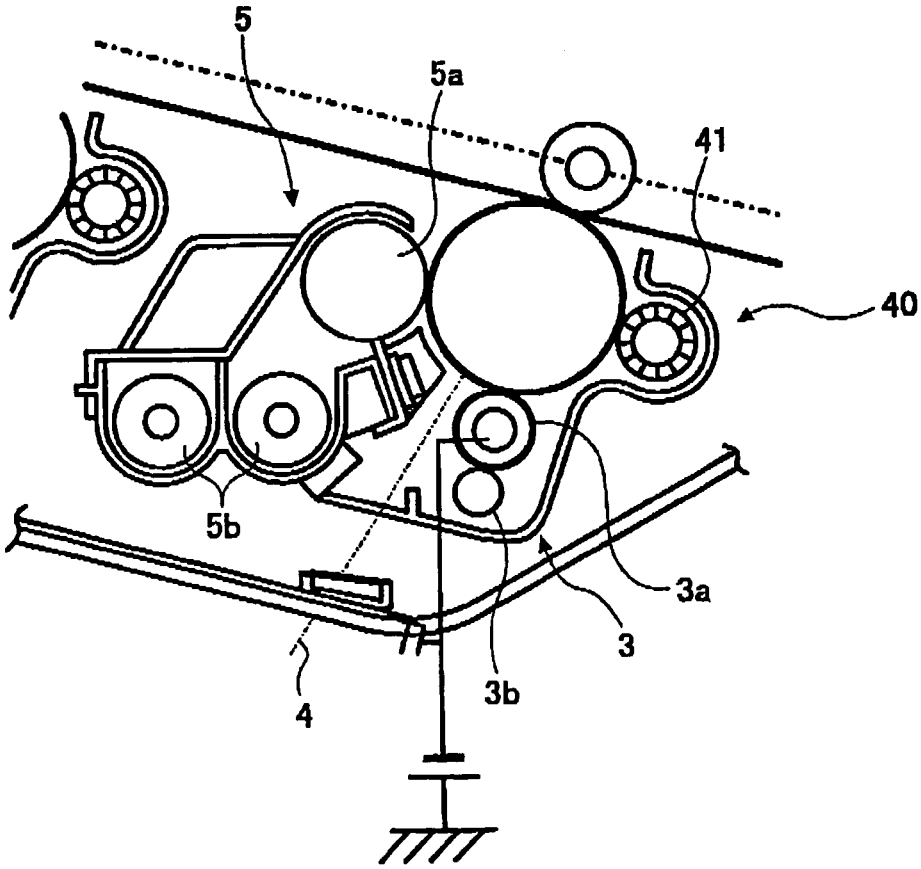
FIG. 3 shows a sectional view of a photoreceptor drum of the toner applying and cleaning cartridge of FIG. 2.

FIG. 3 is a schematic figure of a process cartridge used in the printer of FIG. 1. FIG. 3 shows the circumference of each photoreceptor drum 1Y, 1C, 1M, 1K. On the circumference of photoreceptor drum 1 there is a toner maintenance device 40 configured as a temporary holding means. There is also a charging device 3 for charging the drum with electricity, and a developing device 5, each disposed around the surface of the drum 1. There is a space between charging device 3 and developing device 5 where light, emitted by an exposure device 4, can pass to photoreceptor drum 1.

Charging device 3 charges the surface of photoreceptor drum 1 with electricity in a cathodic nature. Charging device 3 consists of contact/proximity type charging roller 3*a*. I.e., charging device 3 makes charging roller 3*a* come in contact with the surface of photoreceptor drum 1, and charges the surface of photoreceptor drum 1 uniformly by applying cathodic charges.

In one embodiment, an electricity bias of the direct current is applied to charging roller 3*a*, so that surface electrical current potential of photoreceptor drum 1 becomes −500V uniformly. In another embodiment, an alternating current bias is superimposed with the direct current bias.

However, because an interchange power supply is required for this embodiment, use of an alternating current bias is less preferable from the viewpoint of miniaturization of a device. In addition, a cleaning brush 3*b* configured to clean the surface of charging roller 3*a* is disposed in contact with charging device 3.

In the present embodiment, very little toner adheres to the surface of charging roller 3*a*. However, the effectiveness of charging roller 3*a* can be degraded when even a little toner sticks to the face of the charging roller 3*a*. Thus, in one embodiment, the surface of charging roller 3*a* is cleaned by a cleaning brush 3*b*.

In another embodiment charging device 3 can also comprise a thin film (not shown) wound in an axis direction around both ends of the charging roller 3*a*. In this constitution, charges are applied from charging roller 3*a* to the surface of photoreceptor drum 1 across the air gap bounded by the two thin films and the surfaces of the charging roller 3*a* and photoreceptor drum 1.

With either of these embodiments, an electric discharge occurs between the surface of charging roller 3*a* and the surface of photoreceptor drum 1 by means of an electricity bias applied by charging roller 3*a*. In this way, the surface of photoreceptor drum 1 is charged evenly, is exposed by exposure device 4, and an electrostatic latent image corresponding to every color is formed.

In one embodiment, exposure device 4 is a laser system, but other embodiments may include a LED array or a bonding image means as exposure device 4.

Developing device 5 in the present embodiment uses the developer consisting of a toner and a carrier, but a developer that does not include a carrier may be used. In addition, developing device 5 includes developing roller 5*a* is a developer carrier and is partially exposed in an opening of developing device 5.

Developing device 5 receives the supplying of a toner from toner bottle 31Y, 31C, 31M, 31K shown in FIG. 1. Toner bottles 31Y, 31C, 31M, 31K are detachable from the apparatus to enable easy changing.

Each toner bottle 31Y, 31C, 31M, 31K is easily removable when the toner is depleted or otherwise. By not including the toner in the process cartridges, the process cartridges are subject to removal as often as conventional toner/process cartridges as toner usually depletes much sooner than when the mechanical parts of the process cartridge wear out. This feature provides for reduced operational costs. However, in an alternative embodiment not shown, the device of FIG. 1 does not include toner bottle 31Y, 31C, 31M, 31K. In this alternative embodiment, the toner is stored in the process cartridges.

A toner replenished in developing device 5 is stirred with a carrier by means of conveyance screw 5*b*, and is conveyed to developing roller 5*a*. Developing roller 5*a* comprises an inner magnet roller (not shown) and an outer developing sleeve (not shown).

The surface of developing roller 5*a* moves faster than that of photoreceptor drum 1. Toner carrier projects from developing roller 5*a* to the surface of photoreceptor drum 1 by the magnetic force that the magnet roller generates. To effect this transfer, a developing bias of −300 V is applied to developing roller 5*a* by a power supply (not illustrated) so a developing electric field is formed in a developing domain. Thus, an electrostatic force facing the electrostatic latent image side is developed between electrostatic latent image on photoreceptor drum 1 and developing roller 5*a*. Then toner on developing roller 5*a* is transferred as an electrostatic latent image on photoreceptor drum 1. An electrostatic latent image on photoreceptor drum 1 is developed by a toner image of a color that supports respectively.

In addition, in one embodiment, developing roller 5*a* is connected to a drive device (not shown) via a clutch (not shown) that can stop a turn of developing roller 5*a* temporary.

Referring back now to FIG. 1, transfer belt 10 is suspended by three support rollers 11, 12, 13 in a tensioned condition, and moves in a direction according to the figured arrow mark. A toner image on each photoreceptor drum 1Y, 1C, 1M, 1K is transferred to the transfer belt 10 by the above-described electrostatic transfer process.

The electrostatic transfer process may include use of a transfer charger to transfer images from the photoreceptor drum 1 to the transfer belt 10. However, it is preferred that a plurality of transfer charge rollers be used so as to prevent dust from being introduced between the transfer belt 10, and the photoreceptor drum 1. Thus, in a preferred embodiment, a first transfer roller 14Y, 14C, 14M, 14K is disposed at the back side of transfer belt 1 that is in contact with a respective photoreceptor drum 1Y, 1C, 1M, 1K.

A first transfer nip part is formed by each first transfer roller 14Y, 14C, 14M, 14K and each photoreceptor drum 1Y, 1C, 1M, 1K. An anodic bias is applied to the first transfer roller 14Y 14C, 14M, 14K, when a toner image on each photoreceptor drum 1K 1Y, 1C, 1M is transferred to the top of transfer belt 10 on the first transfer nip part.

Belt cleaning device 15 removes any toner which remains on the surface of transfer belt 10. Belt cleaning device 15 also collects unnecessary toner which transfers to in the surface of intermediate transfer belt 10. This collection of toner may be accomplished with a fur brush and a cleaning blade. Collected unnecessary toner is conveyed to a waste toner case (not illustrated).

In addition, a second transfer roller 16 is in contact with a part of transfer belt 10 suspended in a tensioned condition by support roller 13. A second transfer nip part is formed between transfer belt 10 and second transfer roller 16. Transfer media (e.g., paper) is sent into this part with a predetermined timing. This transfer media is accommodated in a paper feed cassette 20 under the exposure device 4. The transfer media is conveyed to the second transfer nip part by means of a paper pick-up roller 21, a pair of paper conveying rollers 22.

The transfer belt 10 is suspended by three support roller 11, 12, 13 in a tensioned condition. Transfer belt 10 moves in a direction according to the figured arrow mark. Toner images on each photoreceptor drum 1Y, 1C, 1M, 1K are respectively transferred to the transfer belt 10 by an electrostatic transfer process. An anodic bias is applied to the second transfer roller 16 and a toner image on transfer belt 10 is transferred to the transfer media.

Downstream from the second transfer nip part is a heat fixing device 23. Heat fixing device 23 comprises pressure application roller 23*b* and heat roller 23*a*. The transfer medium which passed through the second transfer nip part is put between these rollers, where heat and pressure are applied. By this, the toner on the transfer medium melts, so a toner image is settled on the transfer medium. Finally, transfer medium with an image affixed fixing is ejected onto the eject tray top (not shown) by eject roller 24.

Figure 4:
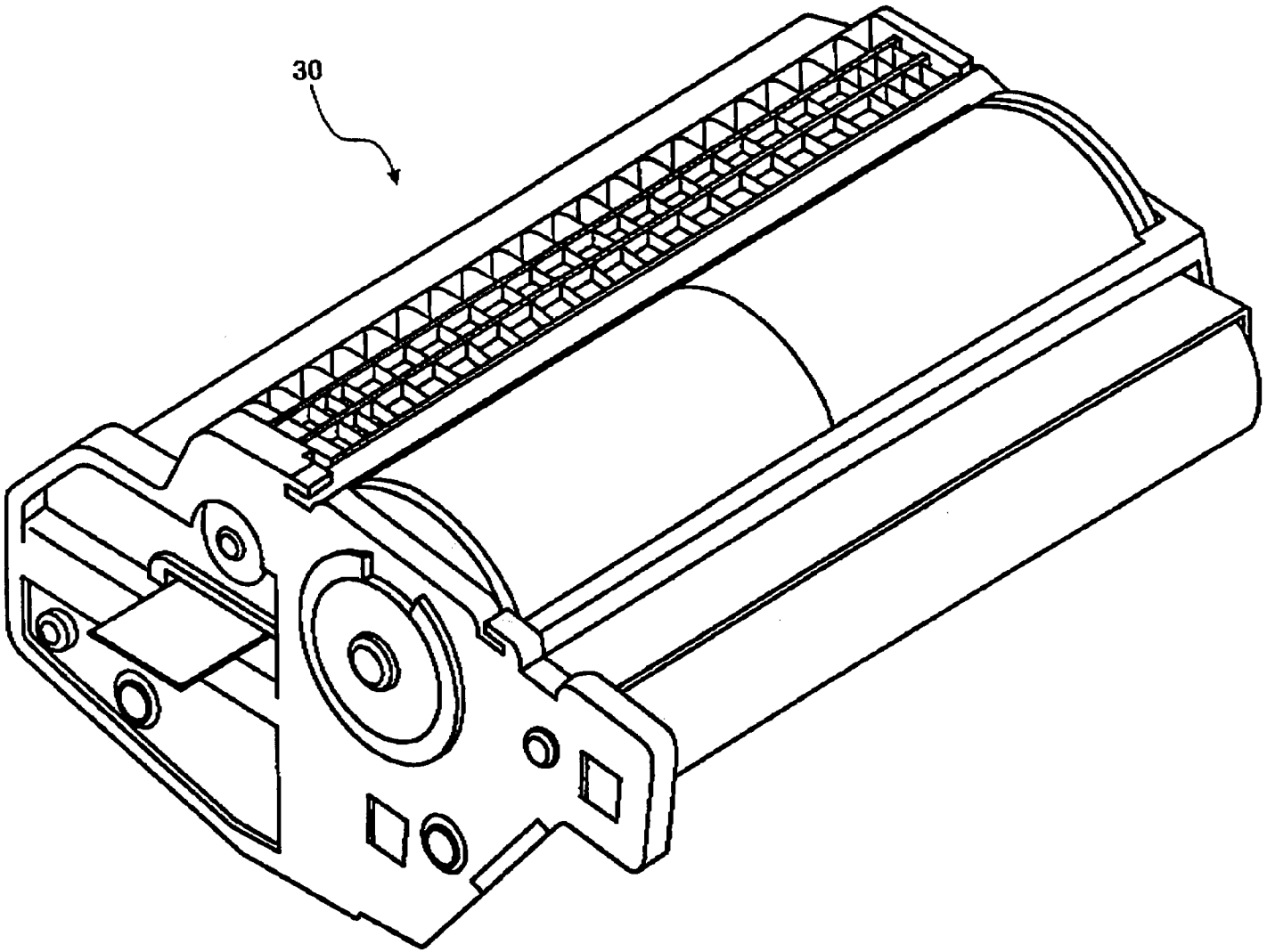
FIG. 4 shows an exterior construction of the toner applying and cleaning cartridge shown in FIG. 2.

FIG. 4 shows an exterior view of the device of FIG. 3, where this device is composed as a process cartridge 30. Like toner bottles 31Y, 31C, 31M, 31Km, process cartridge 30 is easily removable from the printer main body.

A description of how residual toner is cleaned from the surface of each photoreceptor drum 1Y, 1C, 1M, 1K.

In present invention, the toner is formed by a polymerization method, with each particle nearly a perfect sphere. On the other hand, toner particles formed by crush methods has random unevenness on its surface so that the average degree of circularity of this type of toner is low. Toner having a low average degree of circularity also is characterized by a high variation of the particle size. As a result, transfer electric fields do not work effectively and toner deposition is hard to control and can be uneven and excessive.

The present inventors performed the following experiment in order to identify a preferable value of an average degree of circularity of a toner. After having filled up the developer in a developing device, driving the developing device, the time to deplete the toner was measured. The experiment result is shown in the following table 1.

TABLE 1

| Average toner degree of circularity | Observed time (minutes) |
|---|---|
| 0.91 | 2040 |
| 0.92 | 3500 |
| 0.93 | 4300 |
| 0.95 | 4550 |
| 0.97 | 4600 |

These experimental results show that if an average degree of circularity of a toner is more than 0.93, a toner is not depleted until after 4200 minute corresponding to the time necessary to form 150000 images which is a predetermined pass standard. Thus, in one embodiment, a toner with an average degree of circularity equal to or greater than 0.93 is used.

At this point, the average degree of circularity of the toner is the average of circularity of the toner particles. The average degree if circularity is determined using a flow type particle analyzer FPIA manufactured by SYSMEX CORPORATION and the measuring method is as follows. (1) a 1% NaCl aqueous solution is prepared using a first grade NaCl; (2) 1 mg–10 mg of toner is mixed with 50–100 ml of the 1% NaCl aqueous solution from which solid impurities have been removed using a filter having openings of 0.45 $\mu$m and which includes 0.1 ml–5 ml of alkylbenzene sulfonic acid, and 1–10 mg of a dispersant (i.e., a surfactant); (3) the mixture is dispersed using an ultrasonic dispersing machine for 1 minute to prepare a suspension including toner particles of from 5,000 to 15,000 per 1 micro-liter of the suspension; (4) the suspension is passed through a detection area formed on a plate in the measuring instrument mentioned above; and (5) the toner particles are optically detected by a CCD camera and then the shapes thereof are analyzed.

The circularity of a toner particle is determined by the following equation: Circularity=Cs/Cp wherein Cp represents the length of the circumference of the projected image of a toner particle and Cs represents the length of the circumference of a circle having the same area as that of the projected image of the toner particle.

The toner for use in the present invention can be typically prepared by the following suspension polymerization method: (1) mixing raw materials of the toner such as monomers, an initiator, and a colorant; (2) polymerizing the raw materials to prepare toner particles; and (3) subjecting the toner particles to washing, filtering, drying and a post-treatment.

In addition, the toner can be prepared by an emulsion method including: a polymerization step of polymerizing raw materials including monomers, an initiator, an emulsifier and a dispersion medium to prepare an emulsion of particles; an agglomeration step of agglomerating the particles; and steps of washing/filtering, drying and a post-treatment. Further, the toner can be prepared by a bulk polymerization method or a solution polymerization method.

Figure 5:
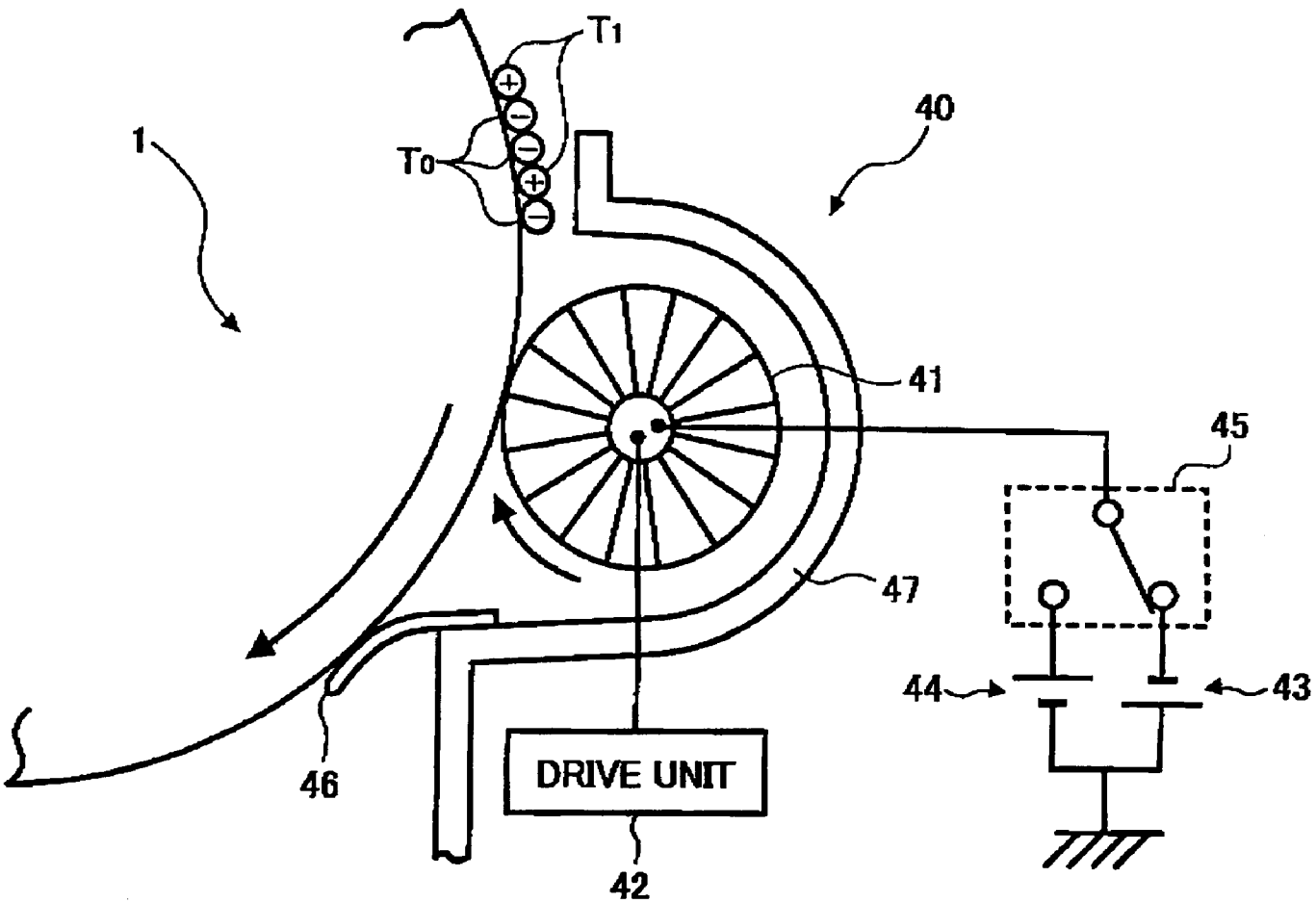
FIG. 5 shows a detailed view of the toner applying and cleaning cartridge of FIG. 2.

FIG. 5 is a detailed diagram of toner maintenance device 40 of FIG. 3. This toner maintenance device 40 comprises brush roller 41 as a means to sweep the surface of photoreceptor drum 1. Brush roller 41 has a low brush density. With a low brush density the brushes include enough air space to collect and hold loosened toner. In addition, by making brush density low, mechanical power required for brush roller 41 is reduced. In one embodiment, brush density is less than 858000 filaments/inch$^2$ and more than 12000 filaments/inch$^2$.

Brush roller 41 is driven by drive unit 42 in the direction of the illustrated arrow mark. A bias is applied to brush roller 41 by either the first power supply 43 or the second power supply 44. Switch 45 is arranged between power supplies 43, 44 and brush roller 41. Switching switch 45 enable a choice of power supply to connect with brush roller 41. Switch 45 is controlled by a control part of the printer.

The first power supply 43 adds a bias of −700 V on a surface part of brush roller 41 while the second power supply 44 adds a bias of +200V. A direct current (DC) power supply is used as each power supply 43, 44. However, other power supplies may be used.

When the maintenance bias on the surface of brush roller is −700 V, reverse charged toner residual T1 previously stuck to the surface of photoreceptor drum 1 now adhere to brush roller 41 due to brushing and the electrical charge.

As described previously relative to FIG. 3, at first photoreceptor drum 1 is charged by charging device 3 uniformly to −500 V, and next it is charged to −50 V by receiving exposure from exposure device 4. And the developing manufacturing process of making a toner stick to the transfer belt 10 the electrical current potential for the latent image part of photoreceptor drum 1 approaches 0 V. Thus, the charged brush roller 41 loosens and collects the reverse charged toner T1.

On the other hand, regular charged toner T0 of a residual toner is charged with cathodic electricity and remains on the surface of photoreceptor drum 1 without being adhered to brush roller 41. Regular charged toner T0 remains on the drum for use in the next picture formation manufacturing process, or is collected by developing device 5.

In addition, brush roller 41 is driven by means of drive 42 to rotate in a direction so that the brushes move against the movement direction of photoreceptor drum 1. Thus, the surface of photoreceptor drum 1 can be brushed with lot of brush tip parts.

As a result of the brushing, regular charged toner T0 on the surface of photoreceptor drum 1 can be mechanically loosened. As a result, it is easier regular charged toner T0 on photoreceptor drum 1 to be collected by developing device 5 is provided.

In an alternative embodiment, brush roller 41 is driven by means of drive 42 to rotate in a direction so that the brushes move with the movement direction of photoreceptor drum 1. This reduces the drive load of brush roller 41 and photoreceptor drum 1 so that a load torque added to brush roller 41 and photoreceptor drum 1 is minimal. In addition, because a load torque added to a drive of photoreceptor drum 1 is minimal, a phenomena called banding is reduced enabling high quality pictures to be formed.

In addition, in one embodiment, a cleaning blade in contact with the surface of photoreceptor drum 1 is not used, thus further reducing a load torque added to a drive of photoreceptor drum 1. However, as a cleaning blade allows for improved ability to clean residual toner remaining on the surface of photoreceptor drum 1, a cleaning blade (not shown) may also be used to remove toner and/or to reduce filming. Embodiments with or without cleaning blades and with counter-rotating or common-rotating brush rollers are possible, thus affording tradeoffs to be made between cleaning and filming and counter-torque.

It is possible for residual toner collected in brush roller 41 to be scattered because of the centrifugal force of rotating brush roller 41 or due to the brush tip leaving the surface of photoreceptor drum 1. In particular, in the case where brush roller 41 drives in the same direction as the photoreceptor drum 1, a residual toner may fly downstream of photoreceptor drum 1. If this flying residual toner is reverse charged toner T1, it can cause an electrical defective in charging roller 3*a*. However, if brush roller 41 is driven in a counter direction like the present embodiment, residual toner flies upstream of photoreceptor drum 1. Therefore, even if residual toner flies up, charging roller 3*a* is not affected.

However, when as in FIG. 3, charging roller 3*a* is disposed under brush roller 41, the toner scattered by centrifugal force may be drawn to the charging roller by gravity, regardless of rotation direction. Thus, in one embodiment, a flexible sheet 46 is disposed between brush roller 41 and charging roller 3*a* to prevent loose toner from contact the charging roller 3*a*. This sheet 46 is formed by materials having flexible nature. The sheet 46 is installed at a lower edge part of casing 47 and made to contact the surface of photoreceptor drum 1. It is important that the surface of photoreceptor drum 1 is not damaged by its contact with the sheet 46. It is preferable that sheet 46 be very flexible. In one embodiment, sheet 46 is formed of urethane resin.

Having held reverse charged toner T1 with brush roller 41, it is eventually necessary to eject the reverse charged toner T1 from the brush roller 41. In one embodiment, the collected reverse charged toner T1 is ejected to the surface of photoreceptor drum 1 at an appointed timing. During this operation, this printer does not perform picture formation, i.e., after finishing one picture formation and before starting the next picture forming, reverse charged toner T1 is ejected.

Referring back to FIG. 3, reverse charged toner T1 is ejected to photoreceptor drum 1 before a surface part of photoreceptor drum 1 that has been electrically charged for next picture formation by charging device 3 reaches a brush contact domain. By ejecting reverse charged toner T1 with such a timing, reverse charged toner T1 can be collected without degrading the next picture formation manufacturing process.

In addition, when doing the picture formation in succession, it is also possible to eject reverse charged toner T1 after having finished the last picture formed in the continuation. After multiple picture formation, the remaining electrical current potential is about −50 V. To release the toner on brush roller 41, switch 45 changes position so that brush roller 41 is switched from first power supply 43 to second power supply 44. The release bias added to brush roller 41 is +200 V. When such a release bias is applied, reverse charged toner T1 held by brush roller 41 goes to photoreceptor drum 1 since the surface electrical current potential is −50 V.

Before any reverse charged toner T1 that ejected from brush roller 41 to the surface of photoreceptor drum 1 arrives at charging roller 3*a*, current applied to charging roller 3*a* is interrupted and charging roller 3*a* is grounded, so the surface electrical current potential of charging roller 3*a* becomes 0 V roughly. On the other hand, because the surface of photoreceptor drum 1 is about −50 V. Therefore, reverse charged toner T1 on photoreceptor drum 1 can pass without sticking to charging roller 3*a*. Thus, reverse charged toner T1 is conveyed to the developing domain.

In one embodiment, before reverse charged toner T1 that arrives at the developing domain, developing roller 5*a* is temporarily stopped with a clutch. By this, toner waste can be suppressed because of sputtering a toner in developing device 5 to the surface of photoreceptor drum 1. In addition, before the reverse charged toner T1 arrives at a developing domain, a bias of −300 V is applied to developing roller 5*a* of developing device 5 as collection means. Thus, the reverse charged toner T1 on the surface of photoreceptor drum 1 (−50 V) is attracted to developing roller 5*a*. The drive of developing roller 5*a* is restarted for next picture formation. The reverse charged toner T1 that collected in developing roller 5*a* is stirred in the inside of developing device 5, and is conveyed, after it is charged with electricity and cured by regular polarity, for reuse.

Among the benefits of the present invention are that the charging of the surface of photoreceptor drum 1 does not vary, picture density can be maintained, and skin dirt can be reduced. In addition, reverse charged toner T1 ejected from brush roller 41 can be recycled with developing device 5. In addition, a toner collection tank is not required and device miniaturization can be achieved. Furthermore, even if a toner remains adhered to brush roller 41, sheet 46 between brush roller 41 and charging roller 3*a* prevent this toner from coming in contact with charging roller 3*a*.

When, for example, during a transfer paper jam, useless toner on the surface of photoreceptor drum 1 must be cleaned. In an embodiment without a cleaning blade, it is difficult to collect such a large quantity of useless toner. Thus, after the interruption is resolved, unnecessary toner left on the surface of the photoreceptor drum 1 is transferred to transfer belt 10 with normal picture formation movement. Referring to FIG. 1, unnecessary toner copied on the transfer belt 10 top is then collected by belt cleaning device 15. Because belt cleaning device 15 has a fur brush and a cleaning blade, it can collect a large quantity of unnecessary toner. After having copied an unnecessary toner onto the transfer belt 10, any toner remaining behind on the surface of photoreceptor drum 1 is reprocessed in the same way with normal picture formation movement.

Figure 6:
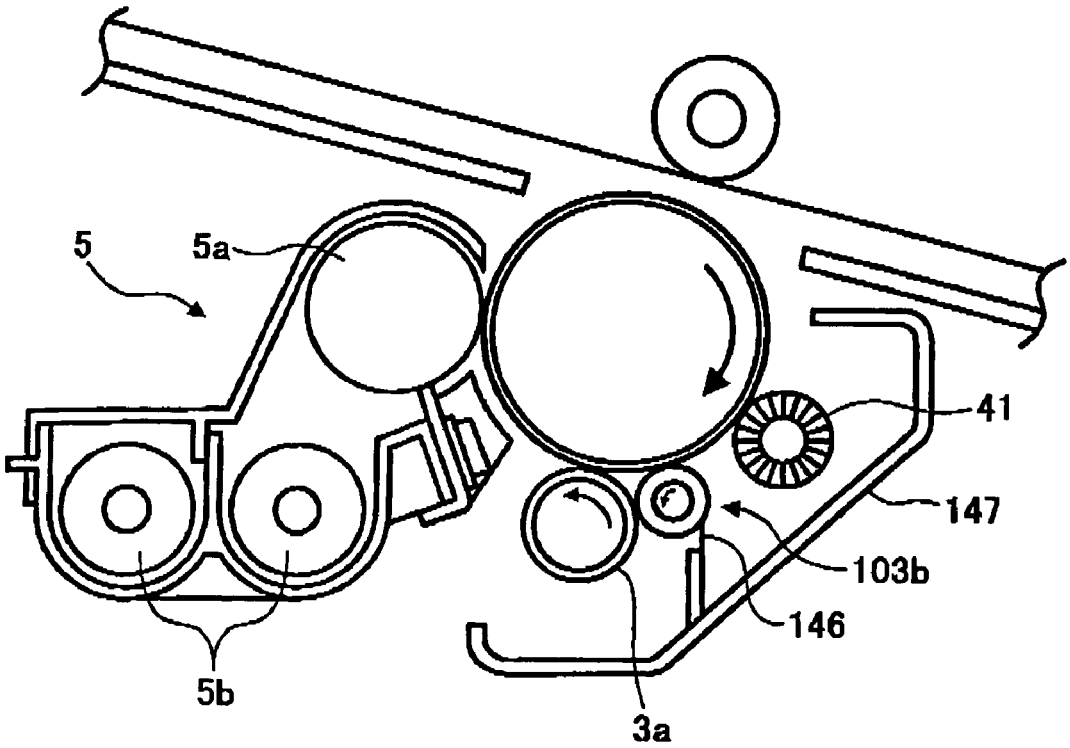
FIG. 6 shows an interior construction of alternative toner applying and cleaning cartridge.

FIG. 6 shows a alternative embodiment to the device of FIG. 3. In this embodiment, cleaning brush 103*b* for charging roller 3*a* is in contact with the photoreceptor drum and is disposed between a charging roller 3*a* and brush roller 41. Scraper 146 is attached to casing 147 and is arranged to scrape toner stuck to cleaning brush 103*b*.

Cleaning brush 103*b* and scraper 146 prevent toner loosened from brush roller 41 or cleaning brush 103*b* from coming in contact with charging roller 3*a*. In addition, because cleaning brush 103*b* rotation drives in anti-clockwise direction, toner which it is scraped with scraper 146 does not drop on the charging roller 3*a* side of scraper 146. The device of FIG. 6 may include all the components of FIG. 3 and 5, to include sheet 46.

In addition, cleaning brush 103*b* abuts the surface of charging roller 3*a* to the surface of charging roller 3*a*. Thus cleaning brush 103*b* abuts both the surface of photoreceptor drum and the surface of charging roller 3*a* between charging roller 3*a* and the brush roller 41.

The apparatus of FIG. 1 includes software programs to enable some or all of the operations previously described.

Finally, referring to FIG. 1, toner bottles 31Y, 31C, 31M, 31K, transfer belt 10, process cartridges 30, and exposure device 4 are each arranged in the printer at a downward slant. This downward slant allows for improved compactness and miniaturization. Similarly, adjacent process cartridges are arranged so an upper process cartridge partially overlaps a lower, adjacent process cartridge in the vertical direction for improved compactness and miniaturization.

What is claimed is:

1. An image forming apparatus, comprising a transfer belt;

at least one process cartridge below the transfer belt, the at least one process cartridge comprising a rotating image carrier having an image carrier surface, a brush roller in contact with the image carrier surface, a charging member either in proximity to or in contact with the image carrier surface, the charging member configured to transfer a charge to the image carrier surface, and a casing, the casing including a flexible sheet in contact with the image carrier surface and arranged to separate the brush roller from the charging member; and an exposure device below the at least one process cartridge.

2. The image forming apparatus of claim 1, further comprising:

at least one toner container positioned above the transfer belt.

3. The image forming apparatus of claim 1, the at least one process cartridge further comprising:

a toner container.

4. The image forming apparatus of claim 1, the flexible sheet comprising:

urethane resin.

5. The image forming apparatus of claim 1, the at least one process cartridge further comprising:

a positive brush charger;

a negative brush charger; and a controllable switch connecting the positive and negative brush chargers to the brush roller.

6. The image forming apparatus of claim 5, the brush roller comprising:

a brush density less than 858000 filaments/inch$^2$ and more than 12000 filaments /inch$^2$.

7. The image forming apparatus of claim 1, the charging member comprising:

a charging roller.

8. The image forming apparatus of claim 7, the at least one process cartridge further comprising:

a cleaning brush roller in contact with at least one of the image carrier surface and the charging roller; and a scraper in contact with the cleaning brush roller.

9. The image forming apparatus of claim 7, the charging roller comprising:

a film wrapped around both ends of the charging roller so as to create an air-gap between the charging roller and the surface of the rotating image carrier.

10. The image forming apparatus of claim 1, wherein the brush roller and the rotating image carrier are configured to rotate in the same direction.

11. The image forming apparatus of claim 1, wherein the brush roller and the rotating image carrier are configured to in opposite directions.

12. The image forming apparatus of claim 1, further comprising:

a first transfer charging device, interior to the transfer belt and opposite the rotating image carrier.

13. The image forming apparatus of claim 12, the first transfer charging device comprising:

a first transfer roller.

14. The image forming apparatus of claim 12, further comprising:

a second transfer charging device, exterior to the transfer belt and arranged downstream from the first transfer charging device and configured to transfer an image from the transfer belt to a transfer medium.

15. The image forming apparatus of claim 14, the second transfer charging device comprising:

a second transfer roller.

16. The image forming apparatus of claim 1, further comprising:

a belt cleaning device.

17. The image forming apparatus of claim 2, the at least one toner container comprising:

toner having an average degree of circularity of 0.93 or more.

18. The image forming apparatus of claim 2, wherein the at least one toner container comprises a plurality of toner containers, the at least one process cartridge comprises a plurality of process cartridges, and each of the plurality of toner containers, the transfer belt, the plurality of process cartridges, and the exposure device are inclined along a first horizontal axis.

19. The image forming apparatus of claim 18, the plurality of process cartridges comprising:

adjacent first and second process cartridges, wherein the first process cartridge partially overlaps the second process cartridge along a vertical axis.

20. The image forming apparatus of claim 19, wherein the first and second process cartridges are parallel to each other in a second horizontal axis, the second horizontal axis orthogonal to the first horizontal axis.

21. An image process cartridge, comprising:

a rotating image carrier having an image carrier surface;

a brush roller in contact with the image carrier surface;

a charging member in proximity to or in contact with the image carrier surface, the charging member configured to transfer a charge to the image carrier surface; and a casing including a flexible sheet in contact with the image carrier surface and arranged to separate the brush roller from the charging member, wherein the flexible sheet comprises urethane resin.

22. The image process cartridge of claim 21, further comprising:

a toner container.

23. The image process cartridge of claim 21, the process cartridge further comprising:

a positive brush charger;

a negative brush charger; and a controllable switch connecting the positive and negative brush chargers to the brush roller.

24. The image process cartridge of claim 23, the brush roller comprising:

a brush density less than 858000 filaments/inch$^2$ and more than 12000 filaments/inch$^2$.

25. The image process cartridge of claim 21, the charging member comprising:

a charging roller.

26. The image process cartridge of claim 25, the process cartridge further comprising:

a cleaning brush roller in contact with at least one of the image carrier surface and the charging roller; and a scraper in contact with the cleaning brush roller.

27. The image process cartridge of claim 25, the charging roller comprising:

a film wrapped around both ends of the charging roller so as to create an air-gap between the charging roller and the surface of the rotating image carrier.

28. The image process cartridge of claim 21, further comprising:

a developing device.

29. The image process cartridge of claim 28, the developing device comprising:

a developing roller in contact with the image carrier surface; and a developing roller power supply connected to the developing roller.

30. The image process cartridge of claim 21, wherein the brush roller and the rotating image carrier rotate in the same direction.

31. The image process cartridge of claim 21, wherein the brush roller and the rotating image carrier rotate in opposite directions.

32. A method for applying an image to a transfer medium, comprising:

negatively charging a surface of a rotating image carrier with a charging roller;

exposing the charged surface of the rotating image carrier with light;

applying toner from a developing roller to the exposed, charged surface of the rotating image carrier via a magnetic field;

transferring toner from the exposed, charged surface of the rotating image carrier to a transfer belt;

cleaning positively charged residual toner from the surface of rotating image carrier with a brush roller charged with negative charge;

grounding the charging roller;

cleaning the brush roller by applying a positive charge to the brush roller so that collected toner is transferred from the brush roller to the surface of a rotating image carrier; and collecting onto the developing roller the toner transferred from the brush roller.

33. A computer program product and memory configured to host instructions and parameters corresponding to the method recited in claim 32.

34. A image transfer apparatus, comprising:

means for negatively charging a surface of a rotating image carrier with a charging roller;

means for exposing the charged surface of the rotating image carrier with light;

means for applying toner from a developing roller to the exposed, charged surface of the rotating image carrier via a magnetic field;

means for transferring toner from the exposed, charged surface of the rotating image carrier to a transfer belt;

means for cleaning positively charged residual toner from the surface of rotating image carrier with a brush roller charged with negative charge;

means for grounding the charging roller;

means for cleaning the brush roller by applying a positive charge to the brush roller so that collected toner is transferred from the brush roller to the surface of a rotating image carrier; and means for collecting onto the developing roller the toner transferred from the brush roller.

35. The apparatus of claim 34, further comprising:

means for transferring an image from the transfer belt to a transfer medium.

36. An image process cartridge, comprising:

a rotating image carrier having an image carrier surface;

a brush roller in contact with the image carrier surface;

a charging member in proximity to or in contact with the image carrier surface, the charging member configured to transfer a charge to the image carrier surface; and a casing including a sheet in contact with the image carrier surface and arranged to separate the brush roller from the charging member, wherein the sheet comprises urethane resin, wherein the brush roller and the rotating image carrier rotate in the same direction.

* * * * *